US006314661B1

(12) United States Patent
Chern

(10) Patent No.: US 6,314,661 B1
(45) Date of Patent: Nov. 13, 2001

(54) SANDAL DEVICE

(76) Inventor: Ming-Dong Chern, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/640,113

(22) Filed: Aug. 14, 2000

(51) Int. Cl.[7] ..... A43B 3/12; A43B 13/18

(52) U.S. Cl. ..... 36/11.5; 36/28; 36/7.8; 36/27; 36/37; 36/29

(58) Field of Search ..... 36/11.5, 7.5, 141, 36/27, 28, 136, 140, 3 R, 3 B, 7.8, 29, 37, 38, 35 R, 35 B, 114

(56) References Cited

U.S. PATENT DOCUMENTS 4,694,831 * 9/1987 Seltzer ..... 36/141
5,224,278 * 7/1993 Jeon ..... 36/29
5,502,901 * 4/1996 Brown ..... 36/28
5,513,448 * 5/1996 Lyons ..... 36/28
5,553,398 * 9/1996 Schnewlin-Maier ..... 36/43
5,649,374 * 7/1997 Chou ..... 36/27
5,651,196 * 7/1997 Hsieh ..... 36/27
5,682,690 * 11/1997 Chang ..... 36/141
6,055,747 * 5/2000 Lombardino ..... 36/37
6,131,310 * 10/2000 Fang ..... 36/28
6,151,807 * 11/2000 Qui et al. ..... 36/140

* cited by examiner

*Primary Examiner*—Paul T. Sewell
*Assistant Examiner*—Jila M. Mohandesi

(57) ABSTRACT

A sandal device has an outsole, an air cushion, and an insole. The air cushion has two periphery flanges, a periphery spacing, a plurality of hollow protrusions, and a plurality of hollow sockets. An elastic woven fabric and a shock-absorbing band are inserted in the periphery spacing of the air cushion. The shock-absorbing band has two periphery recesses for receiving the periphery flanges of the air cushion. Each of the hollow protrusions has a groove for receiving a magnetic block and a collar. A coiled spring has a lower portion inserted in the respective hollow socket and an upper portion inserted in the respective collar.

2 Claims, 5 Drawing Sheets

SANDAL DEVICE

BACKGROUND OF THE INVENTION

The present invention relates to a sandal device. More particularly, the present invention relates to a sandal device which can massage a foot of a user.

A sandal has an insole. A plurality of magnetic blocks can be disposed on the insole to massage a foot of a user. However, the user will feel uncomfortable after a long period of usage.

SUMMARY OF THE INVENTION

An object of the present invention is to provide a sandal device which can massage a foot of a user and the user will feel comfortable while wearing the sandal device.

Accordingly, a sandal device comprises an outsole, an air cushion disposed on the outsole, and an insole disposed on the air cushion. The air cushion has two periphery flanges, a periphery spacing, a plurality of hollow protrusions formed on an upper portion of the air cushion and a plurality of hollow sockets formed on a lower portion of the air cushion to match the hollow protrusions. An elastic woven fabric and a shock-absorbing band are inserted in the periphery spacing of the air cushion. The shock-absorbing band has two periphery recesses for receiving the periphery flanges of the air cushion. Each of the hollow protrusions has a groove for receiving a magnetic block and a collar. A coiled spring has a lower portion inserted in the respective hollow socket and an upper portion inserted in the respective collar. An adhesive band encloses the elastic woven fabric and the shock-absorbing band.

DETAILED DESCRIPTION OF THE INVENTION

Figure 1:
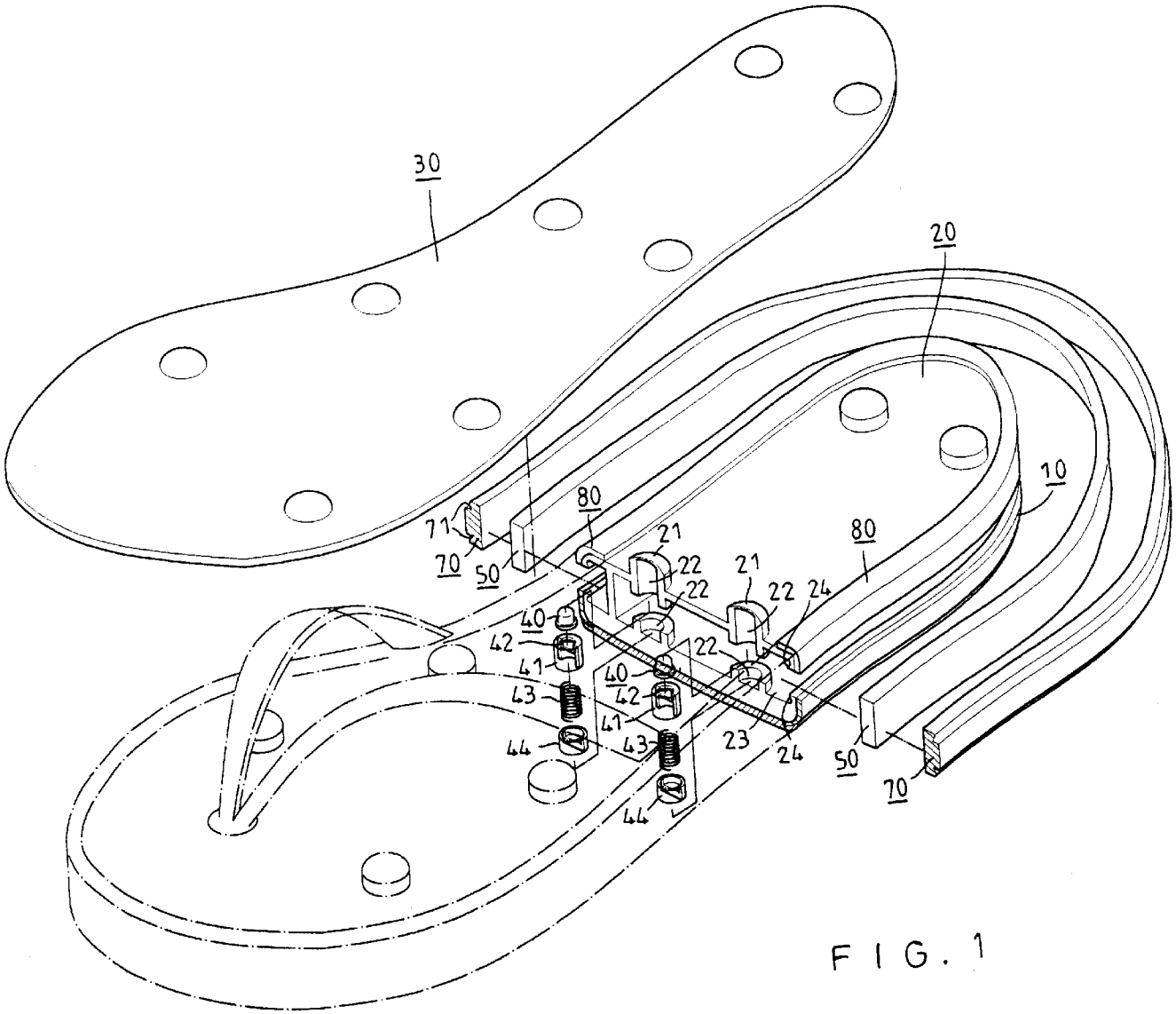
FIG. 1 is a perspective exploded view of a sandal device of a first preferred embodiment in accordance with the present invention.
Figure 2:
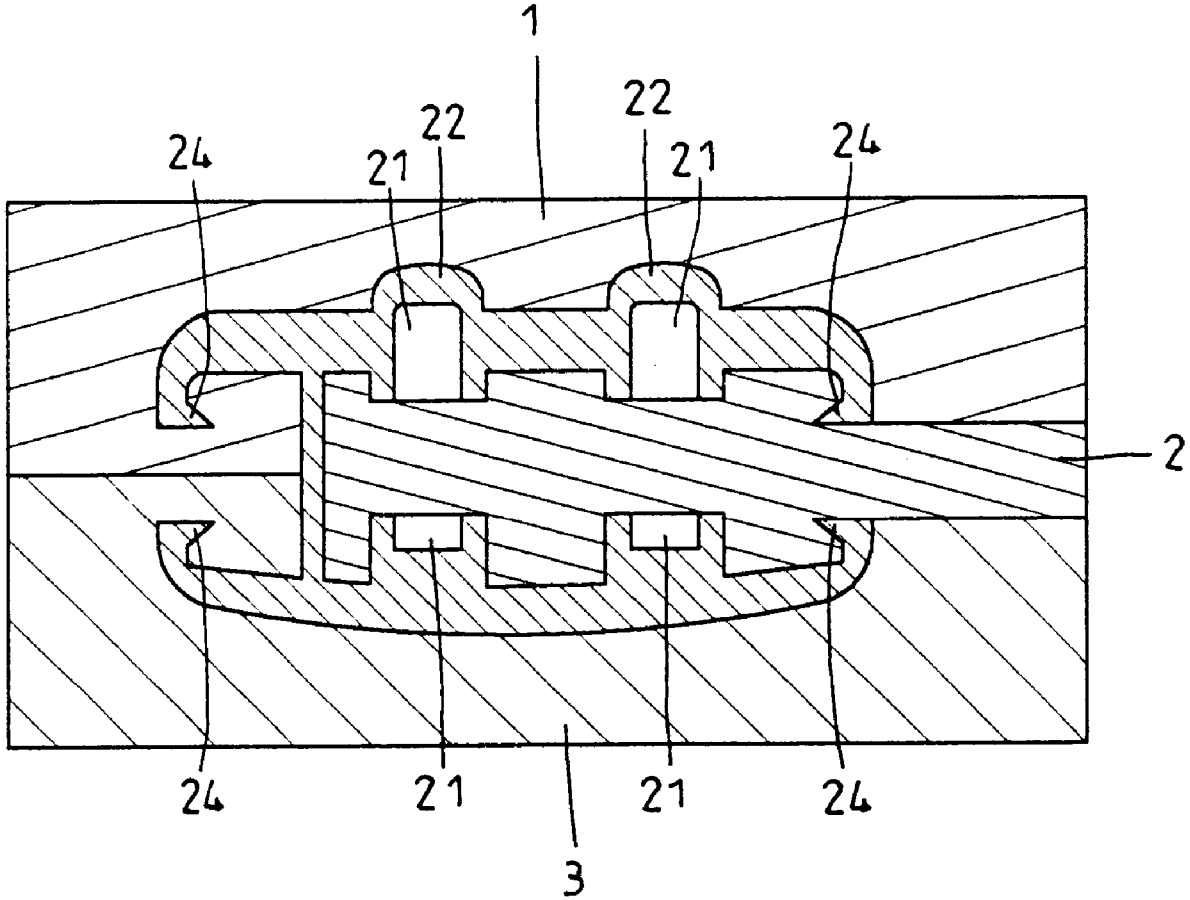
FIG. 2 is a schematic view illustrating a manufacture of an air cushion of a first preferred embodiment in accordance with the present invention.
Figure 3:
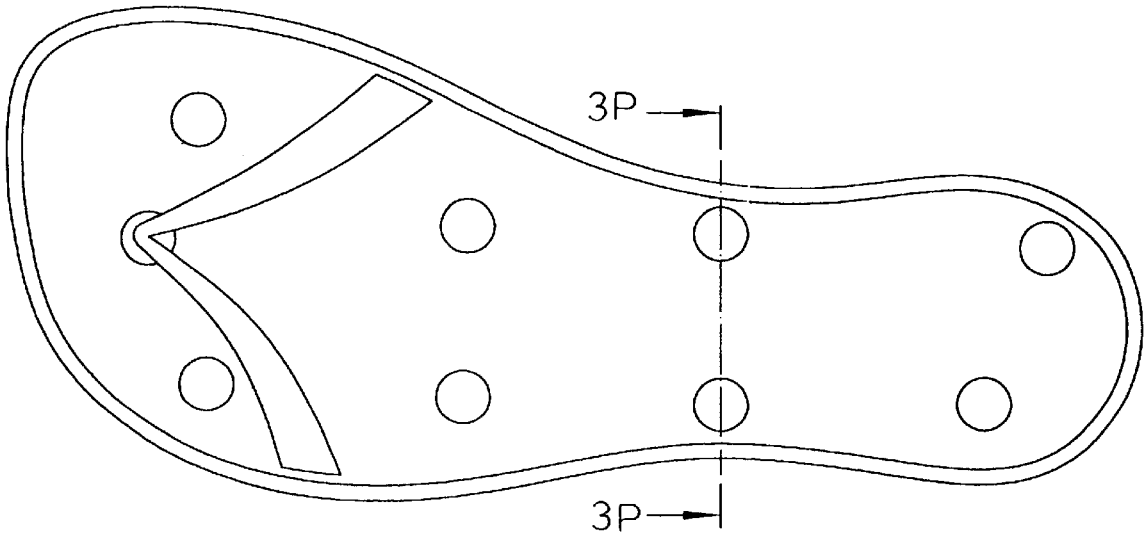
FIG. 3 is an elevational view of a sandal device of a first preferred embodiment in accordance with the present invention.
Figure 3A:
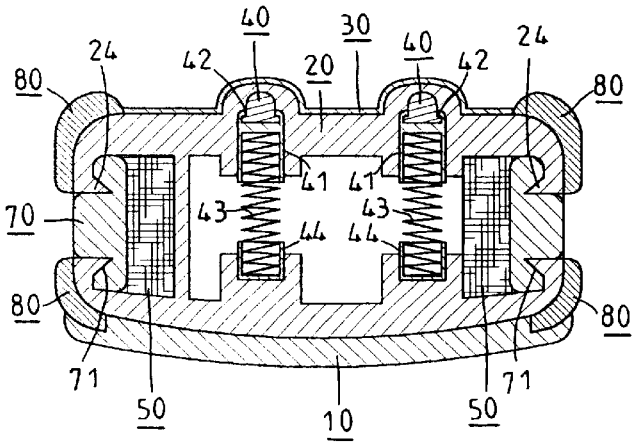
FIG. 3A is a sectional view taken along line 3P—3P in FIG. 3.

Referring to FIGS. 1 to 3A, a first sandal device comprises an outsole 10, an air cushion 20 disposed on the outsole 10, and an insole 30 disposed on the air cushion 20.

The air cushion 20 is formed among an upper mold 1, a middle mold 2, and a lower mold 3 by an injection molding method.

The air cushion 20 has two periphery flanges 24, a periphery spacing 23, a plurality of hollow protrusions 21 formed on an upper portion of the air cushion 20, and a plurality of hollow sockets 44 formed on a lower portion of the air cushion 20 to match the hollow protrusions 21.

An elastic woven fabric 50 and a shock-absorbing band 70 are inserted in the periphery spacing 23 of the air cushion 20.

The shock-absorbing band 70 has two periphery recesses 71 for receiving the periphery flanges 24 of the air cushion 20.

Each of the hollow protrusions 21 has a groove 22 for receiving a magnetic block 40 and a collar 41.

The collar 41 has a through hole 42.

A coiled spring 43 has a lower portion inserted in the respective hollow socket 44 and an upper portion inserted in the respective collar 41.

An adhesive band 80 encloses the elastic woven fabric 50 and the shock-absorbing band 70.

Figure 4:
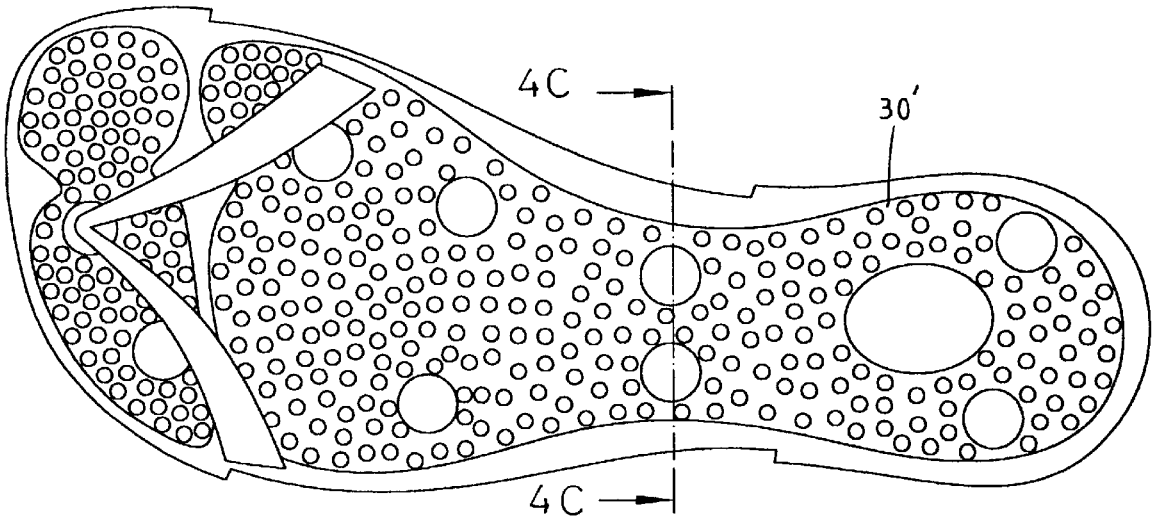
FIG. 4 is an elevational view of a sandal device of a second preferred embodiment in accordance with the present invention.
Figure 4A:
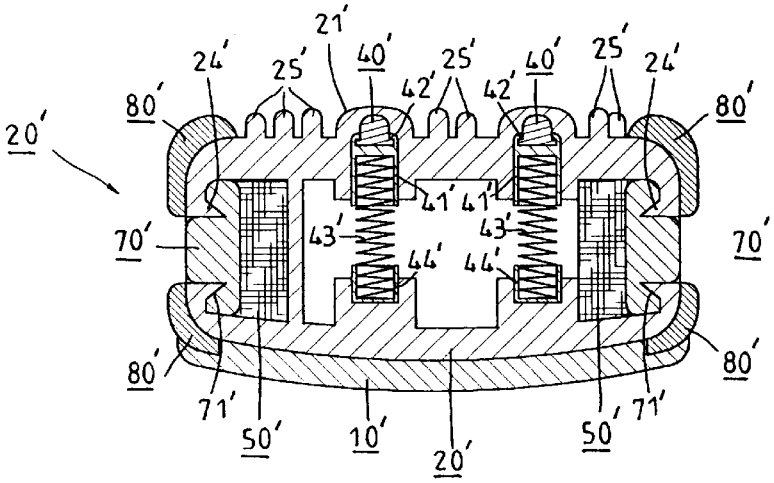
FIG. 4A is a sectional view taken along line 4C—4C in FIG. 4.

Referring to FIGS. 4 and 4A, a second sandal device comprises an air cushion 20', and an insole 30' disposed on the air cushion 20'.

The air cushion 20' has two periphery flanges 24', a plurality of hollow protrusions 21' formed on an upper portion of the air cushion 20', a plurality of hollow sockets 44' formed on a lower portion of the air cushion 20'to match the hollow protrusions 21', and a plurality of upper elastic posts 25'.

An elastic woven fabric 50' and a shock-absorbing band 70' are inserted in the air cushion 20'.

The shock-absorbing band 70' has two periphery recesses 71' for receiving the periphery flanges 24' of the air cushion 20'.

Each of the hollow protrusions 21' receiving a magnetic block 40' and a collar 41'.

The collar 41' has a through hole 42'.

A coiled spring 43' has a lower portion inserted in the respective hollow socket 44' and an upper portion inserted in the respective collar 41'.

An adhesive band 80' encloses the elastic woven fabric 50' and the shock-absorbing band 70'.

Figures 5, 5A:
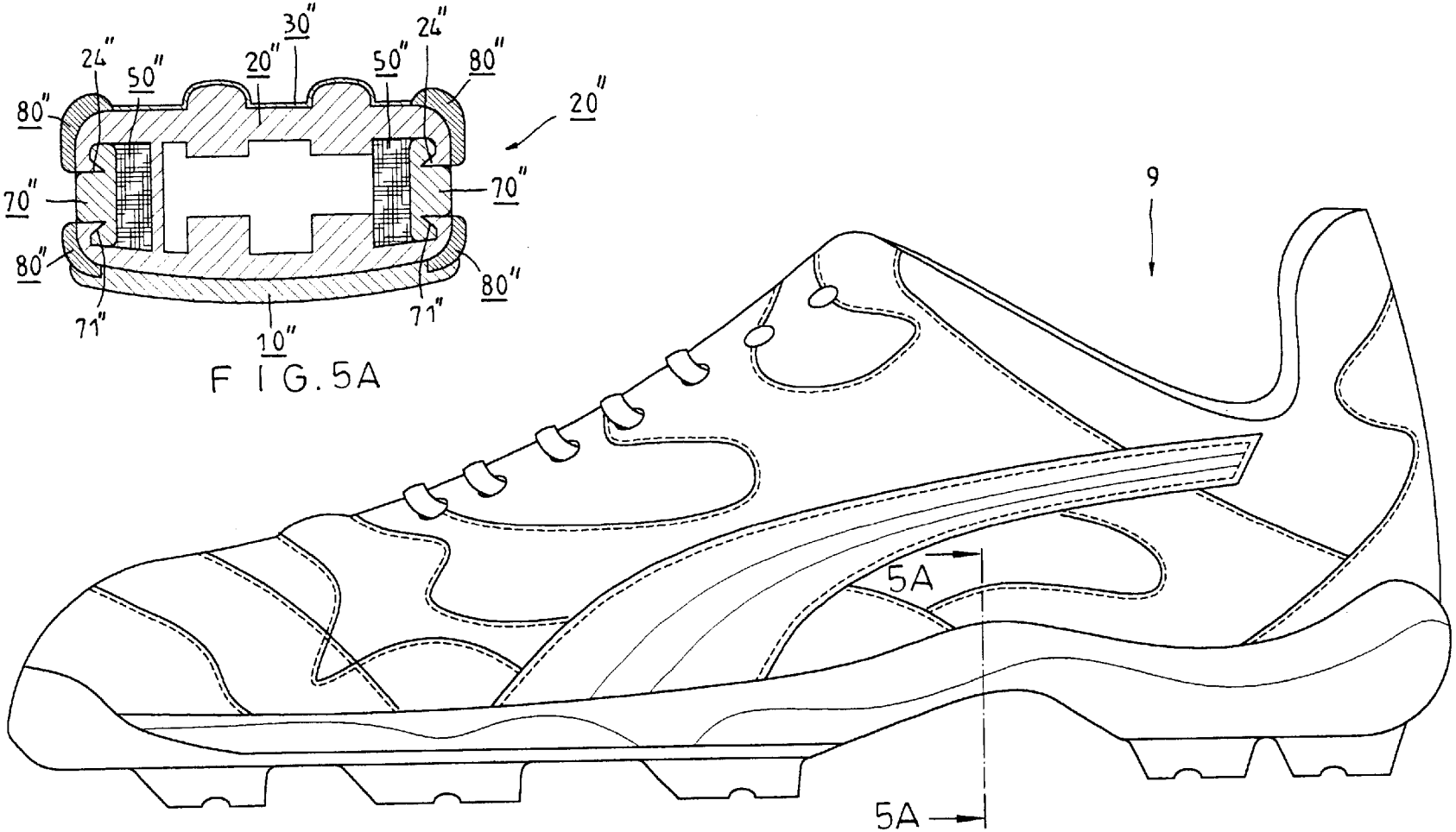
FIG. 5 is a perspective view of a shoe of a third preferred embodiment in accordance with the present invention.
FIG. 5A is a sectional view taken along line 5A—5A in FIG. 5.

Referring to FIGS. 5 and 5A, a shoe 9 comprises an an air cushion 20".

The air cushion 20" has two periphery flanges 24". protrusions 21.

An elastic woven fabric 50" and a shock-absorbing band 70" are inserted in the air cushion 20".

The shock-absorbing band 70" has two periphery recesses 71" for receiving the periphery flanges 24" of the air cushion 20".

An adhesive band 80" encloses the elastic woven fabric 50" and the shock-absorbing band 70".

The invention is not limited to the above embodiment but various modification thereof may be made. Further, various changes in form and detail may be made without departing from the scope of the invention.

I claim:

1. A sandal device comprises:

an outsole, an air cushion disposed on the outsole, and an insole disposed on the air cushion, the air cushion having two periphery flanges, a periphery spacing, a plurality of hollow protrusions formed on an upper portion of the air cushion, and a plurality of hollow sockets formed on a lower portion of the air cushion to match the hollow protrusions, an elastic woven fabric and a shock-absorbing band inserted in the periphery spacing of the air cushion, the shock-absorbing band having two periphery recesses for receiving the periphery flanges of the air cushion, each of the hollow protrusions having a groove for receiving a magnetic block and a collar, a coiled spring having a lower portion inserted in the respective hollow socket and an upper portion inserted in the respective collar, and an adhesive band enclosing the elastic woven fabric and the shock-absorbing band.

2. The sandal device as claimed in claim 1, wherein the air cushion further has a plurality of upper elastic posts.

* * * * *